US005487348A

United States Patent [19]

Cordes

[11] Patent Number: 5,487,348

[45] Date of Patent: Jan. 30, 1996

[54] SEWING MACHINE WITH ELONGATED ARM AND STRENGTHEING PLATE

[76] Inventor: John Cordes, Lot 7 Lindaway Place, Tullamarine, Victoria 3043, Australia

[21] Appl. No.: 173,365

[22] Filed: Dec. 23, 1993

[30] Foreign Application Priority Data

Dec. 23, 1992 [AU] Australia ..... PL6568

[51] Int. Cl.[6] ..... D05B 73/00

[52] U.S. Cl. ..... 112/259

[58] Field of Search ..... 112/155, 163, 112/168, 258, 259, 280, 270

[56] References Cited

U.S. PATENT DOCUMENTS

| | | | |
|---|---|---|---|
| 418,890 | 1/1890 | Dimond et al. | 112/258 |
| 2,561,643 | 7/1951 | Adler | 112/259 |
| 2,828,709 | 4/1958 | Heimann | 112/258 |
| 3,012,532 | 12/1961 | Leslie | 112/258 |
| 3,783,811 | 1/1974 | Schmedding et al. | 112/155 X |
| 4,241,681 | 12/1980 | Porter | 112/258 X |
| 4,399,762 | 8/1983 | Hanyu | 112/259 |
| 4,421,045 | 12/1983 | Portilla | 112/163 X |
| 4,624,201 | 11/1986 | Maggi | 112/260 X |
| 5,167,195 | 12/1992 | Guerreschi | 112/163 X |

FOREIGN PATENT DOCUMENTS

| | | | |
|---|---|---|---|
| 0469477 | 3/1952 | Italy | 112/258 |
| 4026492 | 1/1992 | Japan | 112/259 |

*Primary Examiner*—C. D. Crowder
*Assistant Examiner*—Ismael Izaguirre
*Attorney, Agent, or Firm*—Colucci & Umans

[57] ABSTRACT

A sewing machine having a body 10, a lengthened arm (12), and a sewing head (14), the body being mounted on bed (16) extending the full length and width of the machine; the lengthened arm (12) being attached to a strengthening plate (32) securely attached to the body (10) as well as to the bed (16).

7 Claims, 2 Drawing Sheets

SEWING MACHINE WITH ELONGATED ARM AND STRENGTHEING PLATE

BACKGROUND OF THE INVENTION

1. Field of the Invention

This invention relates to sewing machines and refers particularly, through not exclusively, to long-arm sewing machines created by extending the arm of standard sewing machines.

2. Description of the Related Art

When sewing fabrics of more than standard width a sewing machine having a longer arm is required. The arm of a sewing machine is that part which extends from the main body to the sewing head. Normally, the arm is extended by cutting the arm and inserting all necessary mechanisms and spacers to make the arm the necessary length. This has created several problems.

The principal problem is caused when the extended arm and/or the bed of the sewing machine flex so that the gap between the sewing head at the outermost end of the extended arm and the bed, varies. The flexing is due to the instability of the machine itself.

A second problem of an extended arm is the increased tendency to vibrate at the sewing head. If the variation in sewing height varies due to vibration, the machine can jam. With the vibrations induced in the operation of a sewing machine, it has been found that such arms have tended to allow for flexibility to the stage that the sewing head does move sufficiently to cause jamming of the sewing machine.

With the precision nature of high-speed sewing machines, particularly industrial sewing machines, a variation in the height of the sewing needle above the counter mechanism in the bed of the machine can cause misalignment of the sewing mechanisms or secure of the machine. The variation need only be as little as half a millimeter for this to occur.

Furthermore, with the distance of the sewing head from the body and the weight of the sewing head, the increased bending movement may cause the arm to bend slightly and thus displace the sewing head.

Also, most bodies of sewing machines are made as castings. With the vibration and the extra weight being placed upon the main body a cracking of the body may occur to the stage that a new body is required. This causes the machine to be removed from use and dismantled, with a significant loss of productivity.

In the past these problems have attempted to be overcome by installing bracing along the top of the arm to allow for greater rigidity. Such bracing is normally bolted to the top of the body. It has slightly reduced the vibration or movement of the head, but has increased significantly the cracking problem. However, vibration and movement still occurs.

THE INVENTION

It is the principle object of the present invention to provide a system for the strengthening of lengthened arm sewing machines to allow for greater strength. It is a further object to provide a system for the strengthening of a lengthened arm sewing machines thereby unwanted movement of the sewing head is reduced.

With the above and other objects in mind the present invention provides a sewing machine having a lengthened arm whereby at a joint between said lengthened arm and a body of said sewing machine a strengthening plate is provided securely attached to both said body and said lengthened arm as well as to a bed upon which said sewing machine is mounted. The strengthening plate may be attached permanently, as in gluing or welding; or releasably as in bolts.

Alternatively, the invention may provide a plate secured to an arm of an extended-arm sewing machine and to a bed upon which said sewing machine is mounted adjacent a body of said sewing machine.

DESCRIPTION OF THE DRAWINGS

In order that the invention may be readily understood it shall now be described by way of non-limitative example only and preferred construction of a sewing machine incorporating the principle features of the present invention, the description being with reference to the accompanying illustrative drawings in which.

DESCRIPTION OF THE PREFERRED EMBODIMENT

Figure 1:
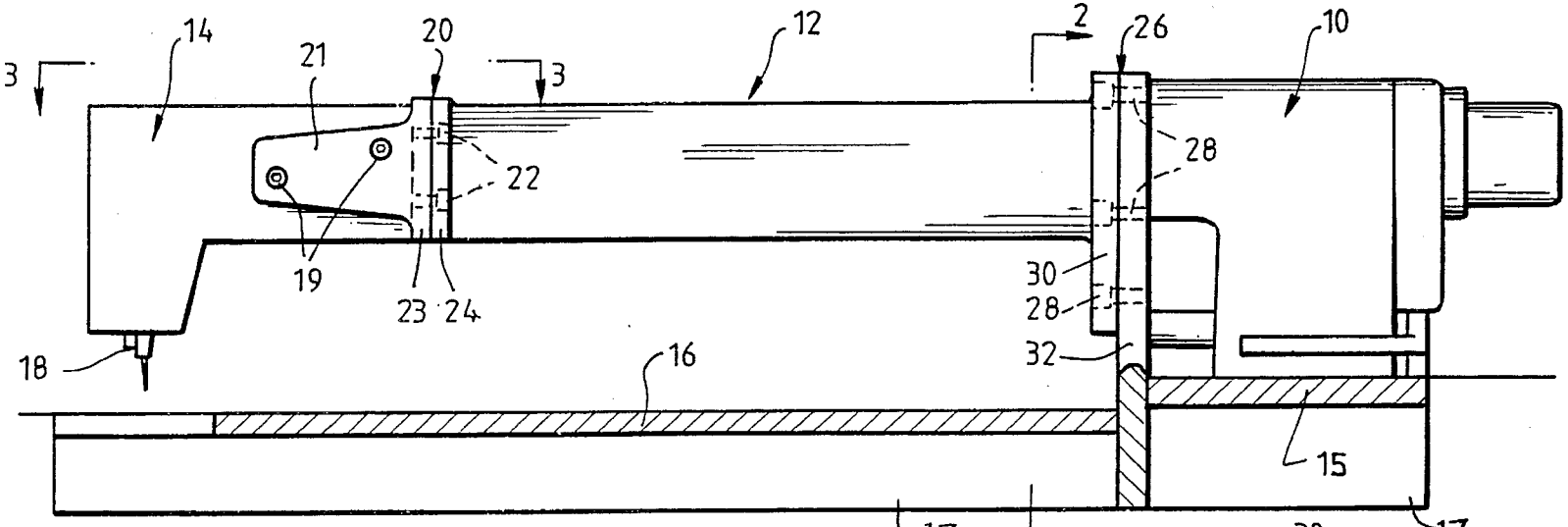
FIG. 1 is a side view in partial section of a first embodiment.
Figure 2:
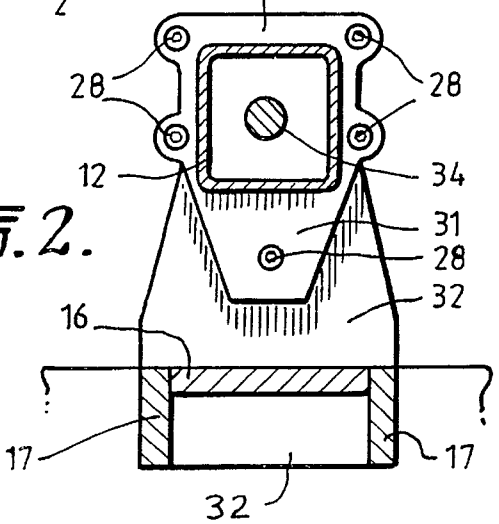
FIG. 2 is a vertical cross-sectional view along the lines and in the direction of arrows 2—2 of FIG. 1.
Figure 3:
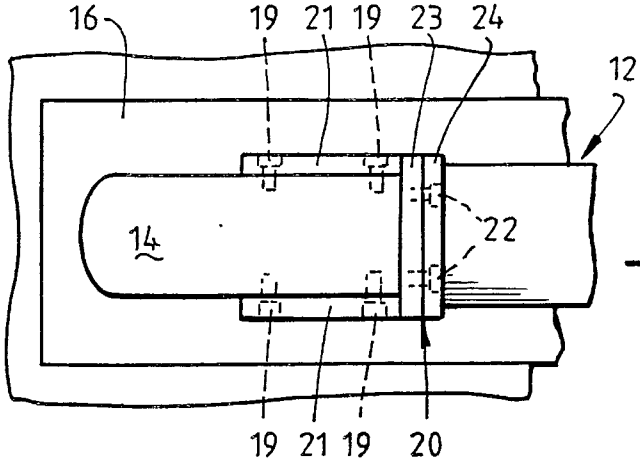
FIG. 3 is a plane view of that part of the machine of FIG. 1 within arrows 3—3 of FIG. 1.

To now refer to FIGS. 1 to 3, the sewing machine has a body 10, an extended arm 12, and a sewing head 14. The body 10 is securely mounted to bed support rails 17 which extend for the full length of the sewing machine and to base plate 15 which is supported between rails 17. Extended downwardly from the sewing head 14 is the needle mechanism 18. Naturally, there are counterpart mechanisms in the bed 16.

The extended arm 12 is joined to the sewing head 14 at a joint 20. This joint uses bolts 22 passing through appropriate flange 24 which is part of the arm 12, and in a flange 23 securely attached to the sewing head 14.

Flange 23 has outwardly extending side-pieces 21 which are attached to the sewing head 14 by bolts 19.

The extended arm 12 is also joined to the body 10 at a joint 26 by using bolts 28 passing through flange 30 which is part of the arm 12, and into a strengthening plate 32 which is securely attached to the body 10 and passes downwardly to and is securely attached the bed 16. As can be seen in FIG. 2, the flange 30 extends well below the arm 12 with an inverted, truncated triangular portion 31 and is attached to the strengthening plate 32 by five bolts 28, one of which is in the inverted, truncated triangular portion 31. Not only is the plate 32 attached to bed 16, but also to bed support rails 17, for additional strength.

The purpose of the plate 32 is to ensure that great stability is provided at the side of the body 10 adjacent to joint 26. In this way any vibration and/or movement of the head 14 and thus needle mechanism 18 is not transmitted through to the body 10. Furthermore, by having the plate 32 secured to the bed 16, great stability is provided to the extended arm 12 so that the risk of vibration and/or movement in the sewing head 14 and thus needle mechanism 18 is reduced.

Within the arm 12 are located all necessary drive mechanisms 34 for the sewing head 14 and the needle mechanism 18. These drive mechanisms 34 are also extended, as required.

In an alternative embodiment, not illustrated, the plate 32 may extend along the underneath, front and/or rear of the arm 12 and be intermediate joint 20 rather than the joint 26. In this way further strengthening to the arm 12 may be provided.

In a further embodiment also not illustrated, the plate 32 may extend as shown and incorporate also a portion intermediate joint 20 and extending under the arm 12 to provide for greater strength and rigidity. This may be required for exceedingly long arms 12.

Naturally the bed 16 has to be extended also. This may be done by cutting the bed 16 intermediate its length, machining the ends to ensure a proper fit, inserting the lengthening piece of any operating mechanisms necessary, and gluing, bolting or welding together the ends and the lengthening piece.

Figure 4:
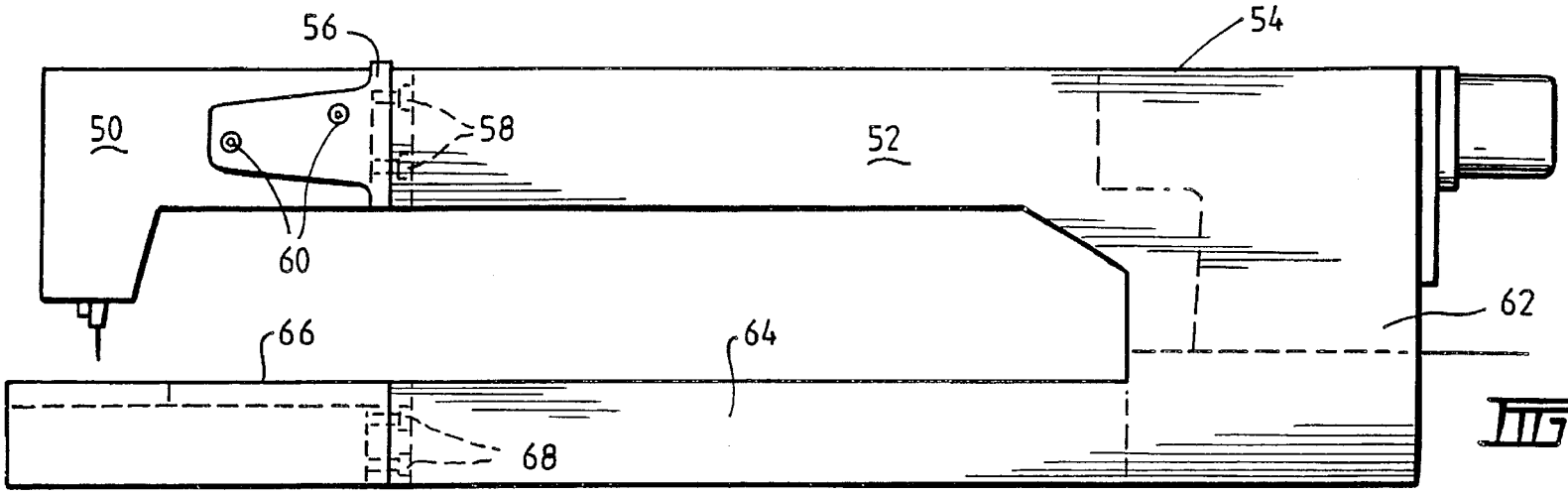
FIG. 4 is a side view of a second embodiment.

To now refer to FIG. 4, there is shown a second embodiment having a sewing head 50 which is attached to a lengthened arm 52 of a body 54. The head 50 has a bracket 56 through which bolts 58,60 pass to secure the head 50 to arm 52. In this instance the arm 52 is a strengthened arm to reduce stress and vibration, and is integral with the motor casing 62 and intermediate bed 64. At the outer end of bed 64 is the sewing machine bed 66, in which is located the operative mechanism. The machine bed 66 is attached to the intermediate bed 64 by bolts 68.

By having an integral body 54 assembly is made easier. However, the length of arm 52 is fixed.

Figure 5:
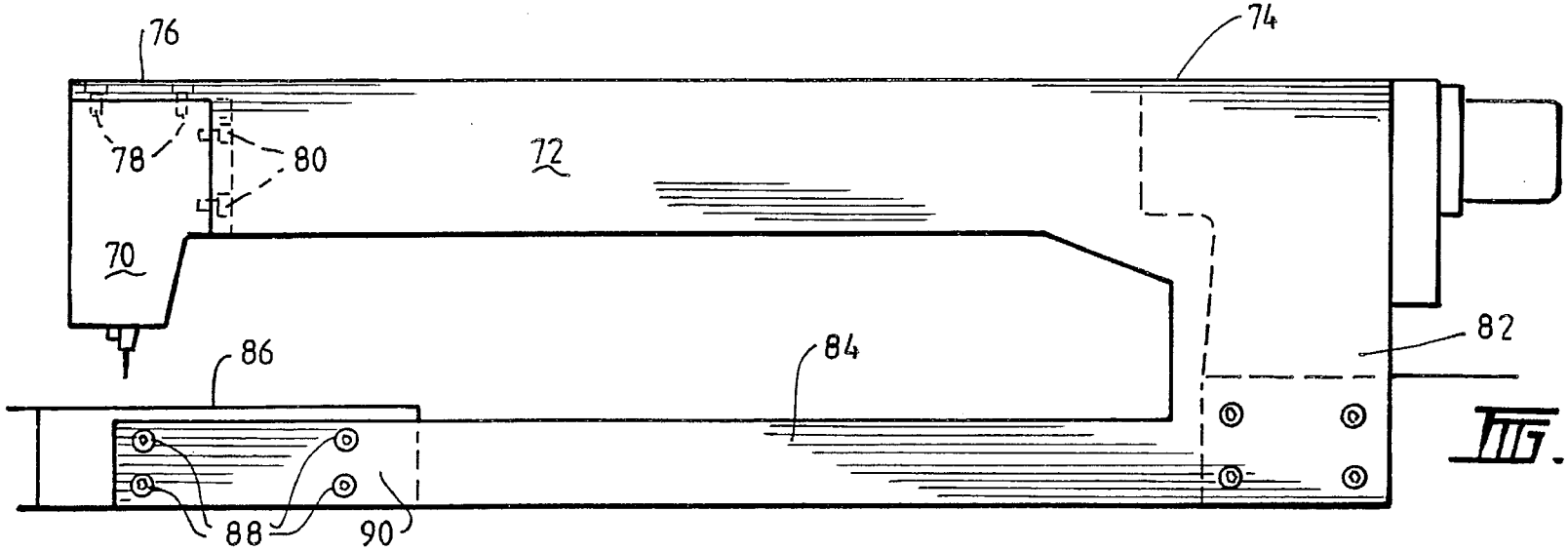
FIG. 5 is a side view of a third embodiment.

In FIG. 5, there is shown a third embodiment having a sewing head 70 which is attached to a lengthened arm 72 of a body 74. The arm 72 has an extension portion 76 through which bolts 78 pass to partially secure head 70 to arm 72. Second bolts 80 also secure head 70 to arm 72. In this instance the body 74 is very much the same as body 54 of FIG. 4 and has a motor casing 82 and intermediate bed 84. At the outer end of intermediate bed 84 is the sewing machine bed 86, in which is located the operative mechanism. The machine bed 86 is attached to the intermediate bed 84 by bolts 88 passing through extended side arms 90 of intermediate bed 84.

Whilst there has been described in the foregoing description a preferred construction of a lengthened arm sewing machine and a system for reinforcing such a machine, it will be understood by those skilled in the technology concerned that many variations or modifications and details of design or construction may be made without departing from the essential features of the present invention.

I claim:

1. A sewing machine comprising: a sewing head; an elongated arm coupled to one end of said sewing head, said elongated arm having another end; a body associated with motor means for driving the sewing head, said body being coupled to the other end of said elongated arm; a pair of bed support rails securely attached to said body; and a strengthening plate clamped between said elongated arm and said body, said strengthening plate extending downwardly from between said elongated arm and body and being also clamped between said pair of bed support rails.

2. A sewing machine as claimed in claim 1, wherein said elongated arm has a first flange facing said strengthening plate, said first flange being securely attached to said strengthening plate by a plurality of bolts.

3. A sewing machine as claimed in claim 2, wherein said first flange has an inverted, truncated triangular portion extending below said elongated arm.

4. A sewing machine as claimed in claim 1, wherein said sewing machine head has an attachment flange secured thereto, said elongated arm having a second flange facing said attachment flange, said second flange being secured to said attachment flange by a plurality of bolts.

5. A sewing machine as claimed in claim 4, wherein said attachment flange has outwardly extending side-pieces on each side of said sewing head and which are attached to said sewing head by a plurality of bolts.

6. A sewing machine as claimed in claim 1, wherein said strengthening plate is securely clamped to said bed support rails by a plurality of bolts.

7. A sewing machine as claimed in claim 1, wherein said body is coupled to said pair of bed support rails by a plurality of bolts.

* * * * *